United States Patent [19]

Lehman et al.

[11] Patent Number: 4,756,429

[45] Date of Patent: Jul. 12, 1988

[54] CAROUSEL DATA HOLDER

[75] Inventors: Marcus S. Lehman, Lake City; Carl J. Schoberg, Zumbro Falls; Daniel C. Johnson, Rochester, all of Minn.

[73] Assignee: Liberty Diversified Industries, New Hope, Minn.

[21] Appl. No.: 846,229

[22] Filed: Mar. 31, 1986

[51] Int. Cl.[4] ..... A47B 65/00; A47B 47/00; A47F 5/02

[52] U.S. Cl. ..... 211/43; 211/163; 211/205

[58] Field of Search ..... 211/41, 58, 165, 163, 211/43, 205, 196, 168

[56] References Cited

U.S. PATENT DOCUMENTS

| | | | |
|---|---|---|---|
| 1,742,164 | 12/1929 | Berke | 211/163 X |
| 2,726,318 | 12/1955 | Marschke | 211/43 X |
| 3,266,634 | 8/1966 | Tintary | 211/163 X |
| 3,498,471 | 3/1970 | Dirkx | 211/163 X |
| 3,524,554 | 8/1970 | Ruhhke | 211/163 |
| 3,868,916 | 3/1975 | Ohlson | 211/163 X |

FOREIGN PATENT DOCUMENTS

| | | | |
|---|---|---|---|
| 1477261 | 4/1967 | France | 211/58 |
| 2390136 | 1/1979 | France | 211/41 |

*Primary Examiner*—Alfred C. Perham
*Attorney, Agent, or Firm*—Moore & Hansen

[57] ABSTRACT

A data carousel stand for accessible storage of data-holding materials is disclosed, having a base, a hollow vertical central hub for adjustably supporting a hollow vertical newel. One or more data carousels is rotatively mounted on the newel, each carousel comprising a plurality of radial arms in vertically adjustable offset stacked array. Each arm has a slidable upwardly extending bracket on each side which cooperate to hold data-containing materials therebetween.

23 Claims, 4 Drawing Sheets

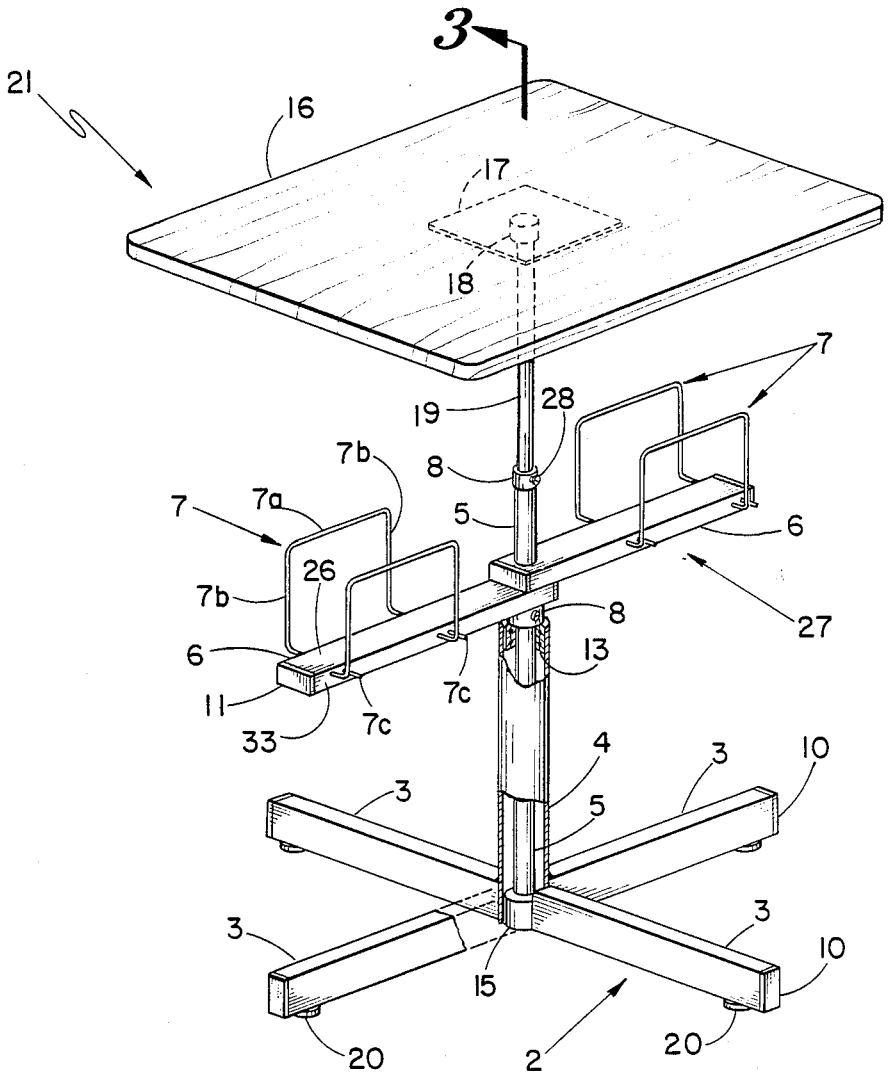
Fig.-2
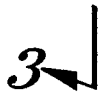

CAROUSEL DATA HOLDER

BACKGROUND OF THE INVENTION

This invention relates to a stand for holding flat materials such as books, files, boards, and phonograph records. More particularly, the present invention relates to a stand for accessible storage of data-holding materials in the form of books, binders containing computer printouts, film, tape, disks, and the like. The invention especially relates to a stand for easily accessible storage of such materials at a desk or work station.

The increased use of electronic data processing in the business and scientific environment has generally resulted in a proliferation of hard copy data; that is, data generated or processed electronically but produced in printed form on paper or film for further manual processing or use. In the business workplace, the particular end use of hard copy records has resulted in custom designed and built storage facilities. Such facilities are difficult to modify for accommodating quickly changing storage requirements.

In the modern open or semi-open type office arrangement, where particular data must be accessible to more than one person, the need for accessible, readily movable free-standing storage units is obvious.

Prior art storage units have one or two drumlike shelves which rotate about a central shaft. Individual data-holding members cannot be rotated to a new position without rotating the entire "drum" of shelves. Furthermore, the storage space for individual items is not adjustable, or is adjustable only to a limited degree. In the latter case, enlarging the space for one item reduces the space available for other data-holding materials, necessitating movement of some of such materials to other "drums."

The construction of the prior storage units locks a business into a particular storage mode because the units cannot be easily adapted to changing needs.

BRIEF SUMMARY OF THE INVENTION

An object of the present invention is to provide a free-standing data storage unit for holding computer printout binders, catalogs, books and the like for easy access.

A further object is to provide a storage unit which provides ready access of data to persons remaining seated at a desk or work station.

Another object is to provide a storage unit which is accessible from all sides so that several persons can readily access the unit simultaneously.

Another object is to provide a free-standing storage unit in which the storage holders are individually rotatable so that a single binder, catalog, or book is accessible to persons located on opposite sides of the unit.

A further object is to provide a free-standing storage unit in which the holders are vertically adjustable.

Another object is to provide a free-standing data storage unit having holders of adjustable width to accommodate binders, catalogs, books and the like of differing thicknesses.

Another object is to provide a storage unit in which the number of holders is easily increased or decreased to satisfy the particular requirements for storage capacity.

Another object is to provide a free-standing storage unit having a detachable work surface.

A further object is to provide a storage unit which is constructed of readily available materials of construction.

The storage unit is particularly characterized by a free-standing data carousel stand for accessible storage of data-holding materials such as books, computer printout binders, catalogs, film holders, file folders and the like. The stand comprises a base, a hollow central hub upstanding from the base and a hollow tubular newel or post mounted in the hollow central hub and extending upwardly therefrom.

Mounted on the newel is a data carousel comprising a plurality of holder arms projecting radially from the newel. The arms are mounted in vertically adjustable offset stacked array to rotate about the newel. Two upwardly extending brackets are mounted on each holder arm, one on each side. The brackets are laterally spaced to confine data-holding materials therebetween in readily accessible storage.

The resulting storage stand is vertically adjustable and can be adapted to accommodate storage of materials of varied size and quantities. The carousel stand is particularly useful for storage and handling of computer printout data filed in binders.

BRIEF DESCRIPTION OF THE DRAWINGS

FIG. 2 is a perspective view of another embodiment of the invention.

DESCRIPTION OF THE PREFERRED EMBODIMENTS

Figure 1:
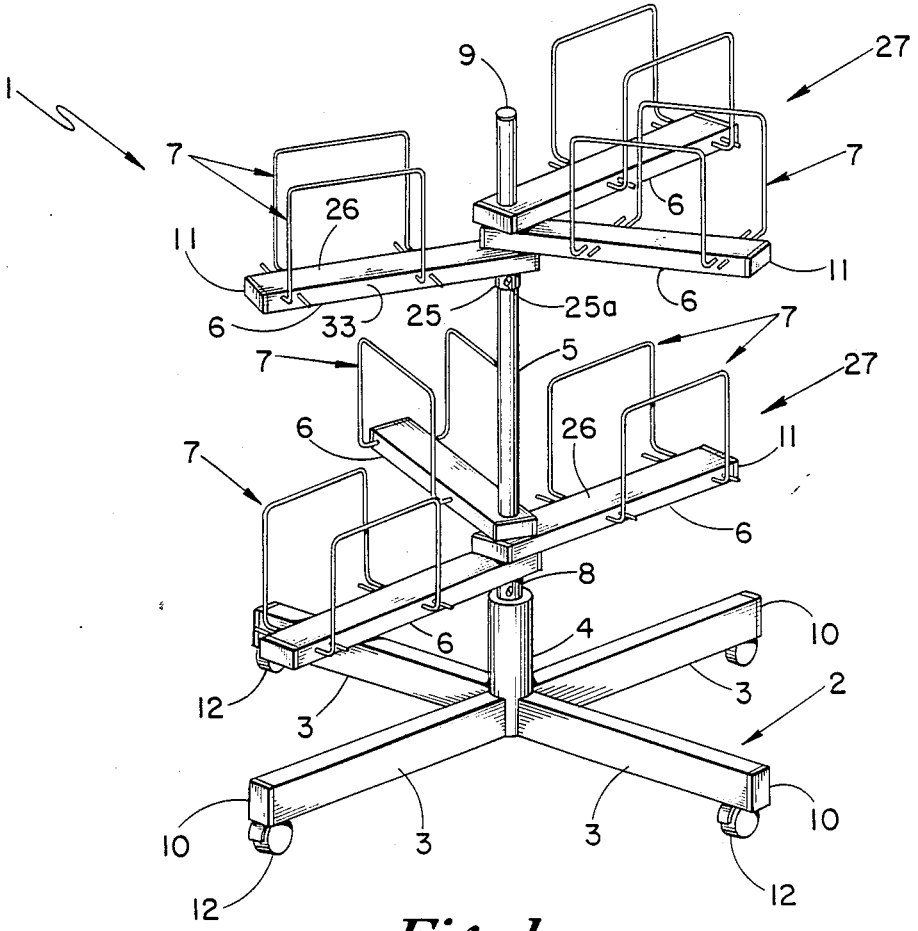
FIG. 1 is a perspective view of one embodiment of the invention.

One embodiment of the data holder has features depicted in FIG. 1.

Data carousel stand 1 provides accessible storage of data-holding materials such as books, computer printout binders, tape, film and the like. The principal elements of stand 1 comprise base 2, a hollow central hub 4 upstanding from base 2, a hollow tubular newel 5 which is mounted in the hub 4, and at least one data carousel 27. Each data carousel 27 comprises a plurality of holder arms 6 which project radially from newel 5. The arms 6 are mounted on newel 5 in vertically adjustable offset stacked array to rotate about newel 5. Two upwardly extending brackets 7 are mounted on each holder arm 6 and are laterally spaced to confine data-holding materials therebetween in readily accessible storage.

Base 2 comprises three or more legs 3 extending radially from hub 4. The inner end of each leg 3 is fixedly attached to hub 4, preferably by welding. A caster 12, or glider 20 as shown in FIG. 2, is mounted on the outer end of each leg 3 to support base 2 on a planar surface such as a floor. The preferred base 2 has four generally horizontal legs 3 equally spaced about hub 4. Each leg 3 is preferably comprised of rectangular, tubular metal bar stock. The four walls of such material provide sufficient strength to support a heavily loaded carousel stand and the legs, being hollow, are lightweight. Leg caps 10 made of rubber, plastic, metal, wood, or other material provide closure of the outer end of each leg 3. The caps 10 provide safe rounded corners for each leg 3 and render an aesthetically pleasing appearance to the apparatus.

As shown in FIG. 1, the hollow central hub 4 is a cylindrical tubular member designed, in this embodiment, to hold a closely fitting newel 5. The newel is a hollow tubular post member, narrower than the hub 4 for fitting within the hub. Newel 5 is retained at the desired level within hub 4 by locking collar 8, fixedly attached to newel 5 for bearing on the upper end of hub 4. In an alternate embodiment shown in FIG. 3, a closure 29 at the lower end of hub 4 supports newel 5. The closure is typically a weldment or a standard screwed plug sealing the bottom of the hub.

Mounted on newel 5 is at least one data carousel 27 comprising a plurality of holder arms 6 mounted on the newel and projecting radially therefrom. The arms 6 are mounted in vertically adjustable offset stacked array to rotate about newel 5. The arms have a vertically aligned hole at their inner ends, and the arms are "stacked" on newel 5, each succeeding arm 6 being located at a higher level on newel 5. Each carousel, or an individual arm within a carousel, may be fixed at a given level by placing and locking a stop ring or locking collar 25 beneath the carousel 27 or arm 6 on newel 5. A set screw **25*a* in the locking collar 25** permits rapid, vertical adjustment of the arms at any desired location.

Figure 3:
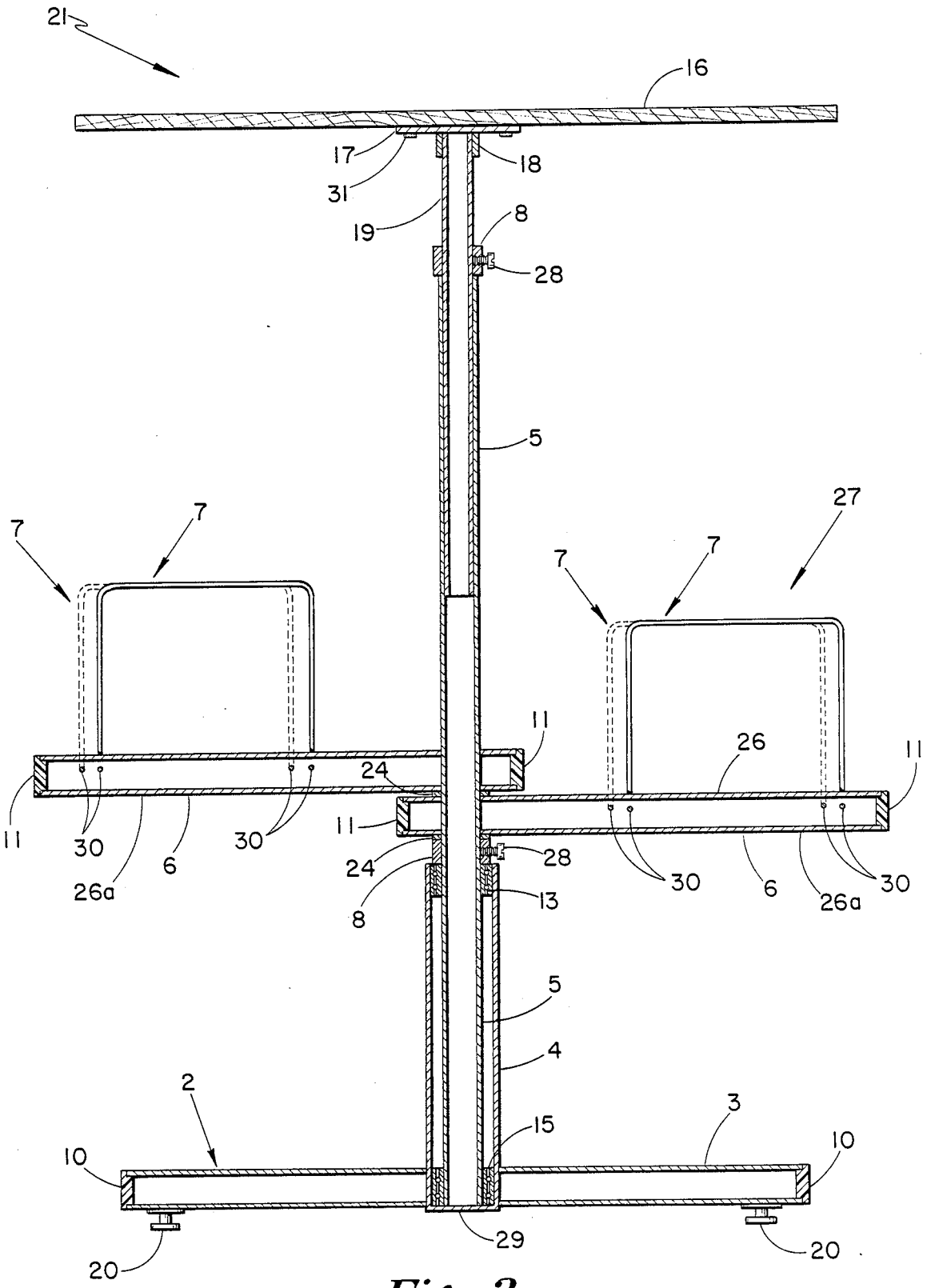
FIG. 3 is a cross-sectional side view of the invention along lines 3—3 of FIG. 2, through the center of the newel, base, and arms.

Preferably, as shown in FIG. 3, a spacer-washer 24 is located between each arm 6 and the next lower arm 6 or collar 8 or 25 for reduced friction rotation of the carousel or arm about the newel.

Like each leg 3, each holder arm 6 is preferably comprised of rectangular tubular extruded metal bar stock. The preferred metals are steel, stainless steel, and aluminum.

Each arm 6 has a generally flat upper surface 26 upon which materials to be stored are placed, and a generally flat lower surface **26*a* which rests upon the next lower arm 6 or a spacer-washer 24. The upper and lower surfaces 26 and 26*a* are joined by a pair of side walls 33**.

As indicated in FIG. 1, both ends of each arm 6 are preferably closed with arm caps 11. These caps are similar in construction and purpose to leg caps 10. Similarly, newel cap 9 fits atop newel 5 to close its upper end.

Each arm 6 has an upwardly projecting bracket 7 mounted on each side 33 for retaining data-holding materials on the upper surface 26. While the bracket may take a variety of forms, the preferred embodiment is formed of wire, as later described. Preferably, at least one bracket on each arm 6 is laterally adjustable to accommodate materials of differing widths.

The holder structure as described thus far is extremely flexible. The holder arms 6 may be easily varied with respect to (a) number, (b) their heights, (c) their locations about the newel, and (d) the capacity of each holder arm 6. The stand provides ease of access of any of the materials stored thereon from any side about its circumference. Each carousel may be rotated in a full circle to gain access to materials located on the opposite side of the stand, and each arm may independently be rotated, to some degree at least, to allow adjustment of arm locations as needed.

Further features of this invention are depicted in FIGS. 2 and 3. Data carousel stand 21 comprises base 2, a hollow central hub 4 upstanding from the base 2, a hollow tubular newel 5 mounted in the hub and projecting upward therefrom, and a data carousel 27.

Legs 3 shown in FIGS. 2 and 3 are identical to those of FIG. 1, and having leg caps 10. In place of the casters 12 each leg has a glider 20 mounted on the outer end for generally stationary use.

Hub 4 could be made in two pieces of different lengths, for height adjustment if desired.

In the particular embodiment of FIGS. 2 and 3, newel 5 is journal mounted in hub 4. A lower antifriction bearing 15 supports the lower end of newel 5 in hub 4, and an upper antifriction bearing 13 allows easy rotation of newel 5 within the hub. A locking collar 14 may be used to lock newel 5 at the desired height.

A vertical spindle 19 comprising a hollow tube is mounted in newel 5 for supporting a table 16 on the data carousel stand 27. A table support plate 17 is attached to the underside of the table 16 by screws 31. As best shown in FIG. 3, the upper end of spindle 19 is screwed into spindle cap 18 which is fixedly attached to the support plate 17. A set screw 28 (FIG. 2) on newel 5 permits adjustment of the table height to meet the particular requirements of the application. Optionally, a locking collar 8 having a set screw 28, as shown in FIG. 3, may be used for adjusting and setting a particular table height. The table 16 is thus rotatable independently from carousel 27.

The carousel 27 shown in FIG. 2 is as previously described. A plurality of holder arms 6 are mounted on newel 5 and radiate therefrom. Brackets 7 are mounted on arms 6 for confining data-holding materials therebetween.

The apparatus of this invention permits a table to be installed on a data carousel when it is used as an independent work station, or where existing desk surface is insufficient.

In each of the embodiments, holder arms 6 preferably comprising rectangular tubular extruded metal bar stock are mounted on newel 5. Newel 5 passes through a hole in the inner end portion of each arm 6. Each arm 6 rests on a spacer-washer 24 (FIG. 3) to provide reduced friction between the rotatable arms and between the lowest arm and locking collar 8. Arm caps 11 attached at each end of arms 6 provide safe rounded corners for each arm and render an aesthetically pleasing appearance.

The preferred embodiment of holder arm 6 has slide holes 30 in sides 33 through which horizontal slide segments 70 of brackets 7 pass. Two spaced holes pass through each side 33 for each bracket 7, and the slide holes for one bracket are slightly offset laterally from the slide holes for the other bracket. In FIG. 3, one bracket on each arm 6 is shown in phantom to illustrate the offset location of the brackets. At least one bracket 7 on each holder arm 6 is laterally adjustable to accommodate data-holding materials of varied widths.

Figure 4:
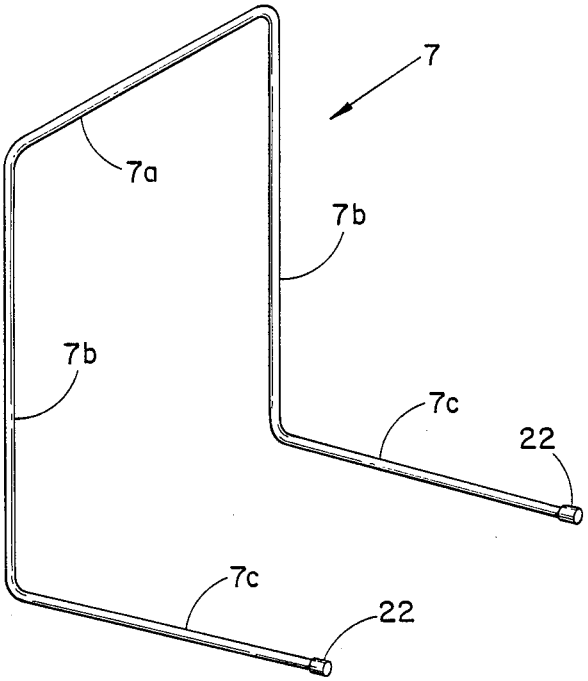
FIG. 4 is a perspective view of a preferred embodiment of a bracket of this invention.

A preferred embodiment of bracket 7 is pictured in perspective view in FIG. 4. The bracket is a wire member bent to form five generally straight sections. Two upwardly extending portions **7*b*, 7*b* are joined at their upper end by a generally horizontal connecting portion 7*a*. Lower slideable portions 7*c*, 7*c*, parallel to each other are generally horizontal and pass through slide holes 30 in holder arms 6 in a friction fit. The bracket is formed with merely four bends. Additional bends generally result in a bracket which bends and breaks more easily. Bracket caps 22, typically made of plastic or rubber, slide onto the ends of segments 7*c*** to prevent the bracket 7 from being inadvertently withdrawn completely from arm 6. The bracket shown in FIG. 4 is easy to manufacture, accepts considerable abuse and is easily adjustable.

Figure 5:
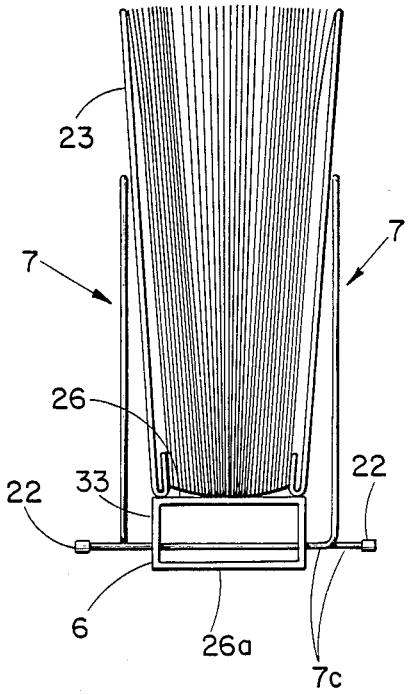
FIG. 5 is an end view, partially in section, of a binder support arm of this invention.

In FIG. 5, a holder arm 6 is shown in end view with a data binder 23 in position as stored. Brackets 7 support the covers of binder 23 in a closed position. Holder arm 6, upon which binder 23 rests, comprises rectangular tubular extruded metal bar stock, preferably steel, stainless steel, or aluminum. Binder 23 is supported on upper surface 26 of the arm, and the lower surface 26*a* rests on the next lower arm or collar. The horizontal lower slideable portions 7*c* of brackets 7 pass through holes 30 in the sides 33, 33 of the holder arm, and are capped with bracket caps 22.

Figure 6:
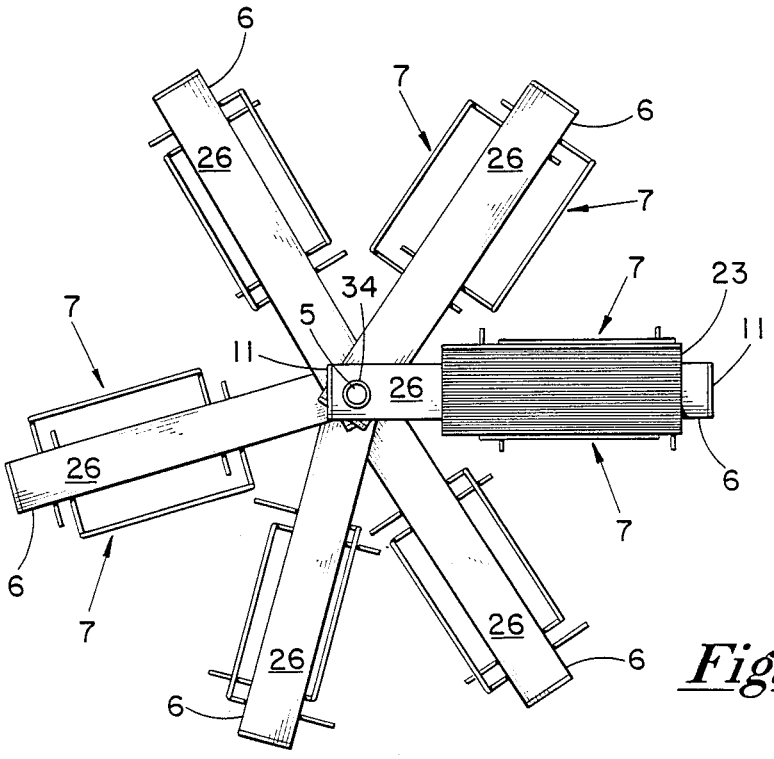
FIG. 6 is a top, plan view of the embodiment of FIG. 1.

The drawing of FIG. 6 is a top view of a carousel 27 of holder arms 6 mounted on newel 5 in spiral staircase fasion. The newel closely fits in the vertical arm hole 34 in each arm 6. A binder 23 is depicted on the upper surface 26 of one arm 6, held between brackets 7, 7.

In this particular arm arrangement, 5–12 arms per full circle are mounted on newel 5. A plurality of full circles of arms may be used in a single continuous carousel 27, provided the vertical dimension of side 33 of a holder arm 6, together with the arm's spacer-washer 24, when multiplied by the number of arms per full circle of arms 6, exceeds the vertical dimension of the data holding material such as binder 23. In this mode, the maximum holding capacity of the apparatus is achieved. Thus, where N=the number of holder arms 6 per 360 degrees;

h=the height of an arm and its spacer-washer 24, and

B=upward extending dimension of the material to be stored in the carousel 27, $Nh > B$ must be satisfied for maximum storage capacity. Thus, where seven arms radiate in each full circle of 360 degrees, and height h is 1.5 inches (3.81 cm), the vertical storage distance available is limited to a maximum of $7 \times 1.5$ inches=10.5 inches (26.67 cm), for a continuous spiral of arms 6 exceeding a single full circle.

Although the invention has been illustrated and described in detail in relation to preferred embodiments, it will be understood that various changes and modifications may be made in the disclosed embodiments without departing from the scope or spirit of the invention.

What is claimed is:

1. A data carousel stand for accessible storage of data-holding materials such as books, computer printout binders and the like, comprising:

a base;

a hollow central hub upstanding from said base;

a hollow tubular newel mounted in said hollow central hub and extending upwardly therefrom; and a data carousel comprising a plurality of elongated holder arms projecting radially from said newel and mounted thereon in vertically adjustable offset stacked array to separately and independently rotate thereabout, and including two upwardly extending brackets mounted on each holder arm, laterally spaced in opposing relation to confine the data-holding holding materials therebetween in readily accessible storage, with each said bracket comprising a generally U-shaped wire member bent to form upwardly extending portions connected at the upper ends thereof by a generally horizontal connection portion extending generally parallel to the elongated direction of extent of the holder arm on which said bracket is mounted, and lower horizontal portions slideably passing generally perpendicularly into each arm through holes in said arms in a friction fit for adjustably varying the lateral spacing between said two brackets on each arm to accommodate materials of differing widths contained therebetween along the length of each arm.

2. The data carousel stand according to claim 1, wherein:

at least one of said brackets on said arm is laterally adjustable towards and away from the other to accommodate materials of differing widths.

3. The data carousel stand according to claim 1, further comprising:

a table mounted on a vertical spindle, a lower portion of said spindle rotatably mounted within said hollow tubular newel to provide a rotatable table surface on said data carousel stand.

4. The data carousel stand according to claim 3, further including:

a locking collar adjustably mounted on said spindle, said collar bearingly communicating with the upper end of said newel to rotatably, removably support said table.

5. The data carousel stand according to claim 3, further including:

a set screw mounted in the upper portion of said newel for locking said spindle at an adjustable height for regulating the elevation of said table.

6. The data carousel stand according to claim 1 wherein:

said base comprises three or more legs extending radially from said hub, each said leg having an inner end fixedly attached to said hub and an outer end with a caster or glider mounted thereon to support said base on a planar surface.

7. The data carousel stand according to claim 6, wherein:

said legs are comprised of rectangular tubular metal bar stock.

8. The data carousel stand according to claim 1, wherein:

said base comprises four generally horizontal legs extending radially from said hub, each said leg having an inner end fixedly welded to said hub and an outer end with a caster or glider mounted thereon to support said base on a planar surface.

9. The data carousel stand according to claim 1, wherein:

said holder arms are comprised of rectangular tubular metal bar stock.

10. The data carousel stand according to claim 1, further comprising:

a welded to screwed closure at the lower end of said hub to support said newel thereon.

11. The data carousel stand according to claim 1, further comprising:

a locking collar adjustably mounted on said newel, said collar resting on the upper portion of said hub to support said newel at an adjustable elevation.

12. The data carousel stand according to claim 1, wherein:

said hollow central hub comprises two sections, a first, lower section attached to said legs and having internal screw threads at the upper end thereof, and a second, upper section having external screw threads at the lower end thereof, whereby said upper section is screwed into said lower section to form said hub.

13. The data carousel stand according to claim 1, further comprising:

antifriction bearings in said hub to rotatively support said newel therein.

14. A data carousel stand for accessible storage of data-holding materials such as books, computer printout binders and the like, comprising:

a base;

a hollow central hub upstanding from said base;

a tubular newel mounted in said hub and extending upwardly therefrom;

a data carousel comprising a plurality of radially projecting holder arms, the inner end portion of each said arm having a vertical hole therethrough for independently, rotatably mounting on said newel in a vertically adjustable offset stacked array of a predetermined number of arms per full circle about said newel in spiral fashion, each said arm having a generally flat upper surface and two sides, and including a pair of upwardly projecting brackets mounted on said sides for holding data-holding materials in confinement therebetween, at least one of said brackets on said arm being laterally adjustable towards and away from the other to accommodate materials of differing widths; and a spacer-washer mounted on said newel between each said arm and the arm immediately below for reduced friction rotation of said carousel about said newel, said arms being stacked in close proximity to each other with each washer bearing against the underside of one arm and the top surface of an adjacent arm.

15. The data carousel stand according to claim 14, wherein:

each said holder arm is independently rotatable about said newel.

16. The data carousel stand according to claim 14 wherein:

the vertical dimension of said side of a holder arm together with accompanying spacer-washer, multiplied by the number of arms per full circle of arms, exceeds the vertical dimension of said data-holding materials. placed on said arms, to permit storage of said materials on all arms of a continuous carousel having unlimited number of holder arms.

17. The data carousel stand according to claim 14, further comprising:

antifriction bearings in said hub to rotatively support said newel therein.

18. The data carousel stand according to claim 14, further comprising:

a welded or screwed closure at the lower end of said hub to support said newel thereon.

19. The data carousel stand according to claim 14 further comprising:

a locking collar adjustably mounted on said newel, said collar resting on the upper portion of said hub to support said newel at an adjustable elevation.

20. The data carousel stand according to claim 14, wherein:

said base comprises three or more legs extending radially from said hub, each said leg having an inner end fixedly attached to said hub and an outer end with a caster or glider mounted thereon to support said base on a planar surface.

21. The data carousel stand according to claim 14, wherein:

each said bracket comprises a wire member bent to form upwardly extending portions connected at the upper end thereof by a generally horizontal connecting portion, and lower horizontal portions slideably passing through holes in said arm in a friction fit for adjustably varying the lateral spacing between said brackets on said arm to accommodate materials of differing widths.

22. The data carousel stand according to claim 14 wherein:

the vertical dimension of said side of a holder arm together with accompanying spacer-washer, multiplied by the number of arms per full circle of arms, is less than the vertical dimension of said data-holding materials placed on said arms, and an upper data carousel comprising holder arms is adjustably lockable by a stop ring on said newel at an elevation above a lower independenly rotatable data carousel comprising a full circle of holder arms, to accommodate data-holding materials of varied vertical dimension on said upper and lower carousels.

23. The data carousel stand according to claim 14, further comprising:

a table mounted on a vertical spindle, and lower portion of said spindle rotatively mounted within said hollow tubular newel to provide a rotatable table surface on said data carousel stand.

* * * * *